US005711281A

United States Patent [19]

Lorraine

[11] Patent Number: 5,711,281

[45] Date of Patent: Jan. 27, 1998

[54] FUEL INJECTOR WITH AIR ATOMIZATION

[75] Inventor: Jack R. Lorraine, Newport News, Va.

[73] Assignee: Siemens Automotive Corporation, Auburn Hills, Mich.

[21] Appl. No.: 736,152

[22] Filed: Oct. 24, 1996

[51] Int. Cl.[6] ..... F02M 23/00

[52] U.S. Cl. ..... 123/531; 239/415

[58] Field of Search ..... 239/409, 414, 239/415; 123/531, 585

*Primary Examiner*—Noah P. Kamen

*Attorney, Agent, or Firm*—Russel C. Wells

[57] ABSTRACT

An air assist atomizer is used for obtaining a desired air flow through a fuel injector, the fuel injector having an injector valve stem, and the injector valve stem movable over a displacement. The air assist atomizer has an air passage via which atomizing air enters and a fuel passage via which atomized fuel exits. An injector seat is mounted on a spring for holding the injector seat to the injector valve stem over the displacement. The injector seat is allowed to travel part of the displacement of the injector valve stem, whereby when the injector seat moves, the air passage is opened allowing bypass air to atomize the fuel. A mechanical stop is provided for halting movement of the injector seat, while the injector valve stem moves the remaining distance of the displacement, opening up the fuel passage.

8 Claims, 1 Drawing Sheet

FUEL INJECTOR WITH AIR ATOMIZATION

FIELD OF THE INVENTION

This invention relates generally to fuel injectors of the type that are used to inject liquid fuel into the induction system of an internal combustion engine and having an atomizer that fits over the tip end of the injector to promote the atomization of the liquid fuel emitted by the fuel injector, and particularly to a soft seat injector for interrupting air flow such that it is introduced only when needed.

BACKGROUND OF THE INVENTION

Air assist atomization of the liquid fuel emitted from the tip end of a fuel injector is a known technique that is used to promote better preparation of the combustible air/fuel mixture that is introduced into the combustion chambers of an internal combustion engine. A better mixture preparation promotes both a cleaner and a more efficient combustion process, a desirable goal from the standpoint of both exhaust emissions and fuel economy.

The state of the art contains a substantial number of patents relating to air assist atomization technology. The technology recognizes the benefits that can be gained by the inclusion of special assist air passages that direct the assist air into interaction with the injected liquid fuel. Certain air assist fuel injection systems use pressurized air, from either a pump or some other source of pressurization, as the assist air. Other systems rely on the pressure differential that exists between the atmosphere and the engine's induction system during certain conditions of engine operation. It is a common technique to mount the fuel injectors in an engine manifold or fuel rail which is constructed to include assist air passages for delivering the assist air to the individual injectors.

Prior techniques used to construct the air assist injector assemblage are tedious and imprecise. Furthermore, current air assist injectors have a free continuous flow of air. At idle, then, almost all of the air flow is coming from the air assist passage, which limits the pressure that can be used and also requires a tight seal at the throttle blade.

It is seen then that there exists a need for the advantages of intermittent air flow to the air assist injector.

SUMMARY OF THE INVENTION

This need is met by the soft seat injector for air assist injection, in accordance with the present invention. Currently, the air assist injector has a free continuous flow of air. The present invention interrupts the air flow such that it is only introduced when it is needed, simultaneously with the fuel flow.

In accordance with one embodiment of the present invention, the injector seat is mounted on a spring and allowed to travel part of the displacement of the injector valve stem. When the valve seat moves, it opens up the air passage, allowing the bypass air that helps atomize the fuel. The seat is held to the valve stem by a spring over the displacement. The seat then reaches a mechanical stop and the valve stem moves the remaining distance of the displacement, opening up the fuel passage.

It is an advantage of the present invention that it provides intermittent air flow. The intermittent air flow reduces the amount of air introduced at idle conditions. It is a feature of the present invention that it coordinates air flow with fuel flow, thereby minimizing the amount of air flowing into the manifold. This improves the ability to control idle. Also, more air can be allowed to flow during the time the injector is open, improving the atomization and relaxing tolerances on the air orifice.

For a full understanding of the nature and objects of the present invention, reference may be had to the following detailed description taken in conjunction with the accompanying drawings and the appended claims.

DESCRIPTION OF THE PREFERRED EMBODIMENT

The soft seat injector tip of the present invention precisely coordinates, or schedules, air flow with fuel flow. This minimizes the amount of air flowing into the manifold, improving the ability to control idle. Also, more air can be allowed to flow during the time the injector is open, improving the atomization and allowing for relaxed tolerances on the air orifice.

Figure 1:
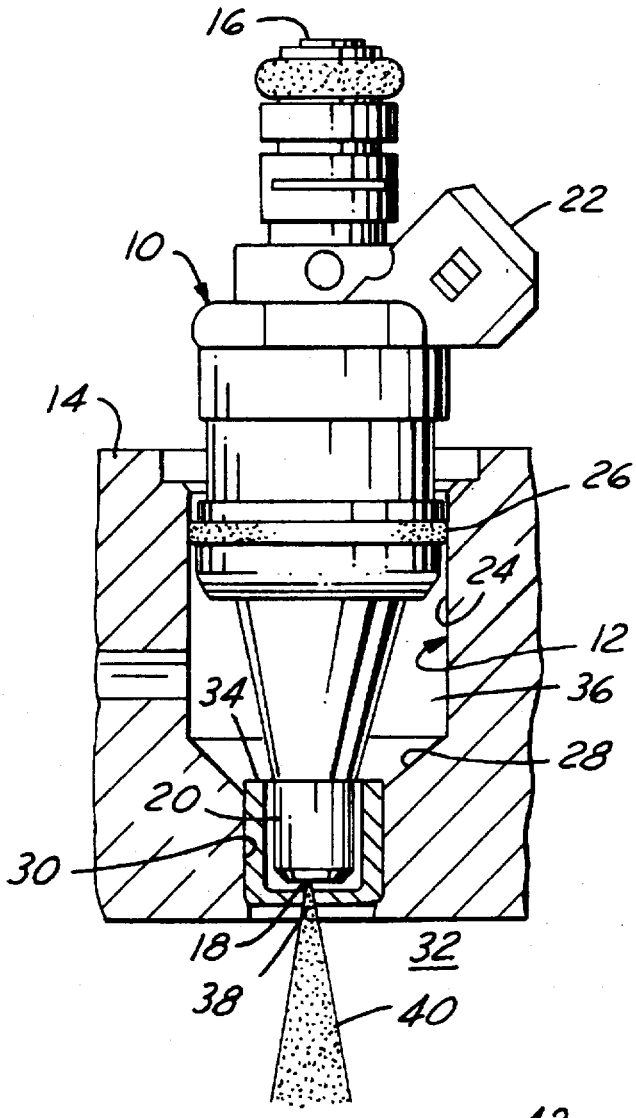
(PRIOR ART) FIG. 1
FIG. 1 is an elevational view partially in cross section through a manifold socket containing a fuel injector having prior art air assist atomizer.

Referring now to FIG. 1, there is shown, for purposes of description only, a top-feed, solenoid-operated fuel injector 10, which is typically mountable in a socket 12 of an engine manifold assembly 14. The engine also has a fuel rail (not shown) which is associated with the fuel injector 10 to deliver pressurized liquid fuel to the injector's fuel inlet 16 which is at one axial end of the injector 10.

Continuing with FIG. 1, any suitably shaped socket 12 may be used to accept a portion of the injector 10 that is adjacent the opposite axial end of the injector, including the injector's fuel outlet 18 which is at a tip end 20 of the injector 10. An electrical connector 22 of the injector 10 is shown as exterior of the socket 12 to be accessible for connection to a mating connector of a wiring harness (not shown) via which the injector's solenoid is operated from an electronic engine control.

Socket 12 is in the form of a through-bore which comprises a main circular cylindrical segment 24 to which the fuel injector 10 is sealed by means of a circular o-ring 26. The more interior portion of socket 12 comprises a frusto-conical segment 28 which tapers radially inwardly from segment 24 to a circular cylindrical segment 30 that is open to a main air induction passage 32 of the engine. Passage 32 leads to the engine's combustion chamber space (not shown). The injector's tip end 20 is fitted to segment 30 by means of an atomizer 34, which is typically thimble-shaped.

The manner in which the atomizer 34 functions can now be explained. When the engine is operating, the pressure in induction passage 32 is sub-atmospheric. Hence, a pressure difference exists across the atomizer 34, and this differential is effective to cause air from space 36 to pass axially through the atomizer and exit via an aperture 38 at the tip end of the atomizer 34, associated with the injector outlet 18 which sprays out a fuel spray 40. The air that passes through the atomizer 34 acts on the fuel spray 40 as it is being emitted from the injector tip end 20 to assist in the atomization of the liquid fuel entering induction passage 32.

The atomizer 34 and the injection device tip 20 can be press fit together without preventing air flow therebetween.

The typically thimble-shaped atomizer, as known in the art, comprises an inner part and an outer part which together cooperatively define passage means for the conveyance of assist air to act on the liquid fuel spray 40, shown in FIG. 1, at the point of its emission for promoting atomization of the fuel. The inner part of the atomizer comprises grooves which permit air flow between the two parts, and out the frusto-conical shaped hole centrally disposed in the outer part. Even during a press fit, the grooves inherent in the atomizer still permit air flow.

Although it is desirable, then, to have an air assist injector, engine idle conditions may be adversely affected in such an arrangement. In order to save energy, both the idling rpm and the friction of internal combustion engines have been reduced. As a result, the fuel mixture quantity required during engine idling in fuel-injected engines has decreased. However, existing air assist injectors currently have a free continuous flow of air, even when air flow is not needed, such as during idle conditions. Since virtually all of the air flow during idle is coming from the air assist passage, this limits the pressure that can be used and also requires a tight seal at the throttle blade. Greater pressure would provide better atomization. Additionally, a lesser throttle blade seal is not only easier to manufacture, but also has better tip in characteristics for the transition from idle.

Figure 2:
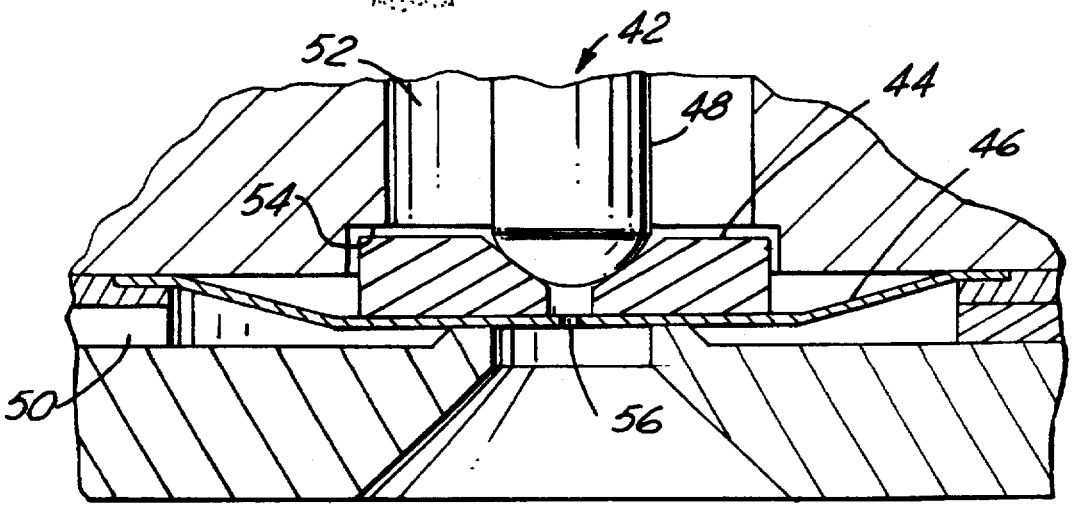
FIG. 2 illustrates the soft seat injector tip, according to the present invention, for use with the air assist injector of FIG. 1.

Referring now to FIG. 2 there is illustrated a soft seat injector tip area 42 which replaces the interface of the injector tip end 20 and the atomizer 34 of the prior art injector of FIG. 1. The soft seat injector tip interrupts air flow such that air flow is only introduced when it is needed, simultaneously with the fuel flow. Injector seat 44 is mounted on a spring 46 and allowed to travel part of the displacement of injector valve stem 48. When the valve stem 48 moves, it opens up the air passage 50, allowing bypass air that helps atomize the fuel, from fuel passage 52. For example, if the injector 10 has a 0.012 inch valve stem 48 movement, the seat 44 would travel with the valve stem for 0.005 inches. This travel would open up the air passage. The seat 44 is held to the valve stem 48 by the spring 46 over the displacement. The seat then reaches a mechanical stop 54 and the valve stem 48 moves the remaining displacement distance, in the example, 0.007 inches, opening up the fuel passage 52.

Continuing with FIG. 2, an orifice disk 56 is typically located between the seat 44 and the air assist passage 50. The orifice disk could be attached to the seat 44, or integrated into the spring means 46 that supports the seat. As will be obvious to those skilled in the art, if the orifice disk 56 is part of the bevel spring 46, as shown in FIG. 2, then the seat 44 would not have to be attached to the bevel spring. This would allow the seat to self center with the valve stem.

Although the magnetic gap in the above example, having a 0.012" valve stem movement, is large, the spring force against the valve stem is counterbalanced by the lesser spring force against the seat. Thus, the magnetic force at the greatest gap required to move the valve stem is less than a conventional design. Also, since the valve stem closes against a suspended seat, the impact transmitted into an audible click will be reduced, thus quieting the injector.

The present invention provides for intermittent air flow, introducing air flow only when it is needed. This has the advantage of reducing the amount of air introduced at idle conditions. Currently at idle, almost all of the air flow is coming from the air assist passage 50, which limits the pressure that can be used and also requires a tight seal at the throttle blade. Greater pressure will provide better atomization. Furthermore, a lesser throttle blade is not only easier to build, but also has better tip in characteristics for the transition from idle.

It should be noted that, with the concept of the present invention, there is a possible leak path through the active joint between the fuel passage and the air assist passage. In accordance with the present invention, then, this passage can be sealed using any suitable sealing means, such as a sliding, rolling or diaphragm type seal. As illustrated in FIG. 2, a bevel type washer 46 could also be used across the path, with the sealing means being sealed at both ends. The bevel type washer also provides the spring force needed to open the air passage.

Having described the invention in detail and by reference to the preferred embodiment thereof, it will be apparent that other modifications and variations are possible without departing from the scope of the invention defined in the appended claims.

What is claimed is:

1. A fuel injector with air atomization for obtaining a desired amount of air flow with fuel flow, said fuel injector having an injector valve stem, and said injector valve stem movable over a displacement length, the fuel injector with air atomization comprising:

an air passage via which atomizing air enters;

a fuel passage via which atomized fuel exits;

means for moving the valve stem from its normal position over the displacement length to its end position;

spring means;

an injector seat mounted on said spring means for holding the injector seat to the injector valve stem from its normal position to a position intermediate said normal and said end positions for opening the air passage allowing atomizing air to flow;

a stop means for halting movement of the injector seat prior to the injector valve stem moving to its end position, opening up the fuel passage; and bias means for returning the injector valve stem to its normal position closing the air and fuel passages.

2. A fuel injector with air atomization as claimed in claim 1 wherein said stop means comprises a mechanical stop.

3. The fuel injector with air atomization according to claim 1 wherein said spring means is a bevel spring.

4. The fuel injector with air atomization according to claim 3 wherein said bevel spring has sealing means around its perimeter.

5. The fuel injector with air atomization according to claim 1 wherein said injector seat is slideably mounted on said spring means for centering said injector seat with said injector valve stem.

6. The fuel injector with air atomization according to claim 1 wherein said spring means additionally includes an orifice.

7. A method for obtaining a desired amount air flow through a fuel injector with fuel flow, said fuel injector having an injector valve stem, and said injector valve stem movable over a displacement length, an air atomizing method comprising the following steps:

providing an air passage via which atomizing air enters;

providing a fuel passage via which atomized fuel exits;

mounting an injector seat on a spring for holding the injector seat to the injector valve stem at its normal position;

moving the injector valve stem from its normal position along its displacement length;

allowing the injector seat to travel over part of the displacement length of the injector valve stem, for opening the air passage allowing atomizing air to flow;

halting the movement of the injector seat;

continuing the movement of the injector valve stem for the remaining distance of the displacement length, opening up the fuel passage, whereby atomizing air flow is coordinated with fuel flow; and then returning the injector valve stem to its normal position on the injector seat closing the air and fuel passages.

8. The method according to claim 7 wherein said step of returning closes the fuel passage prior to closing the air passage.

* * * * *